US006560841B1

(12) United States Patent
Letherer et al.

(10) Patent No.: US 6,560,841 B1
(45) Date of Patent: May 13, 2003

(54) TILE SIGN METHOD

(76) Inventors: Mark James Letherer, 34 Pierce Rd., Barrington, NH (US) 03825; Christopher Mark Tanner, 1201 S. Eads St., #1811, Crystal City, VA (US) 22202-2845

( * ) Notice: Subject to any disclaimer, the term of this patent is extended or adjusted under 35 U.S.C. 154(b) by 20 days.

(21) Appl. No.: 10/041,493

(22) Filed: Jan. 10, 2002

(51) Int. Cl.[7] ..... B21D 39/03; G09F 7/00; B44C 1/26

(52) U.S. Cl. ..... 29/428; 40/584; 428/67

(58) Field of Search ..... 29/428, 445, 425; 40/124.5, 584, 628, 629; 428/67, DIG. 913.3, 195; 52/103

(56) References Cited

U.S. PATENT DOCUMENTS 5,519,892 A * 5/1996 Pizzacar ..... 2/195.2
5,791,752 A * 8/1998 Hartman ..... 312/204
5,989,369 A * 11/1999 Light ..... 156/71

* cited by examiner

*Primary Examiner*—David P. Bryant
*Assistant Examiner*—John C. Hong
(74) *Attorney, Agent, or Firm*—Christopher Mark Tanner, Esq.

(57) ABSTRACT

An apparatus and method for building signs combining tile and wood, such as but not limited to nameplates, is disclosed. The nameplates are produced in several steps, including woodworking, sanding, tile-cutting, stencil-applying, sandblasting, and polishing.

21 Claims, 7 Drawing Sheets

TILE SIGN METHOD

FIELD OF THE INVENTION

This invention relates generally to decorative tile signs and the manufacturing process therefore, such as for use in nameplates.

BACKGROUND OF THE INVENTION

Many types of signs, indicators, nameplates and methods of manufacturing therefor exist, but none combine the convenience and configurability of granite or other tile with the elegance of hard wood.

BRIEF SUMMARY OF THE INVENTION

This invention has as its primary objective the building of signs such as nameplates by applying a stencil having a preselected pattern to a tile made of a material such as granite, grinding and finishing a pattern within that tile, and then inlaying the patterned tile within a wooden base. A further objective is to separately process the tile and wood before combining them, and then to process them again afterward.

These and other objects and advantages of the invention will become readily apparent as the following description is read in conjunction with the accompanying drawings.

DETAILED DESCRIPTION OF THE PREFERRED EMBODIMENTS

Professionals such as loan officers, doctors, automotive salespersons, and other persons skilled in dealing with the general public find the use of nameplates helpful when dealing with a new customer, who may forget their name unless it is kept very prominently visible while a meeting is occurring. Accordingly, the decorative signs of the present invention will include nameplates, but will also include the following: "Mens Room", "Ladies Room", "Please Wait to be Seated", "Next Window Please", "Reserved", "Concierge", "Welcome", and "No Smoking". Additionally, the patterning of graphic symbols and other user-specffied patterns are also contemplated within the scope of the present invention.

Figure 1:
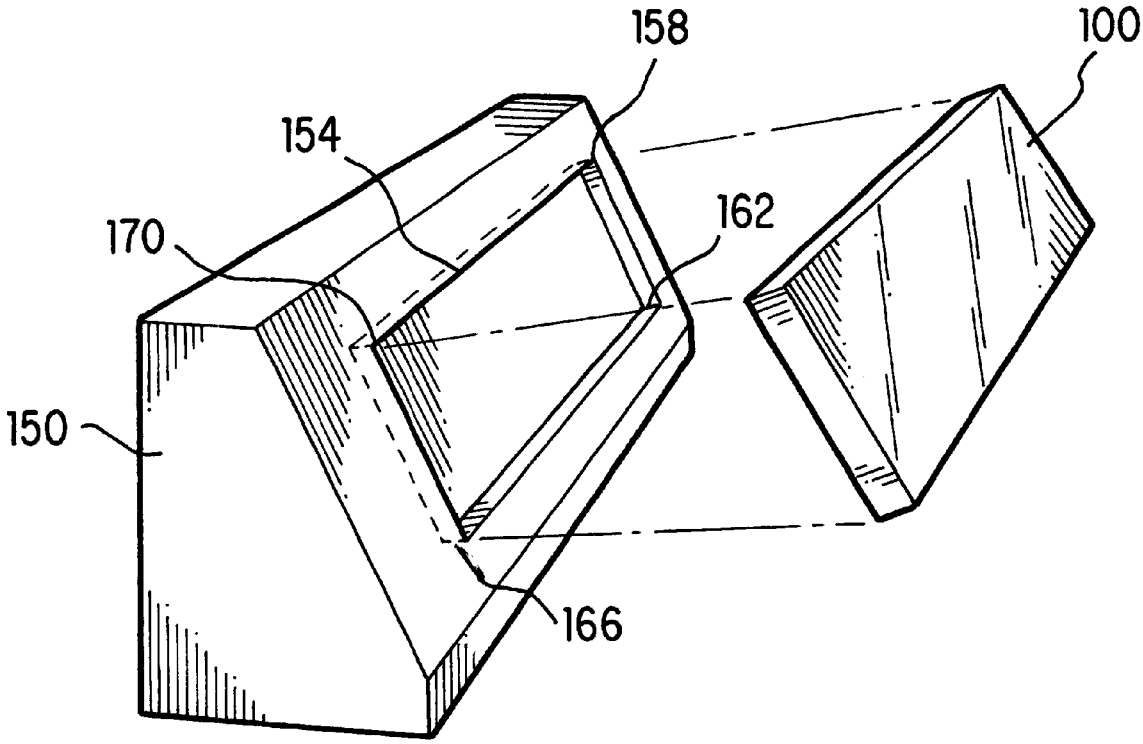
FIG. 1 is an exploded perspective view of a first embodiment of the present invention.
Figure 2:
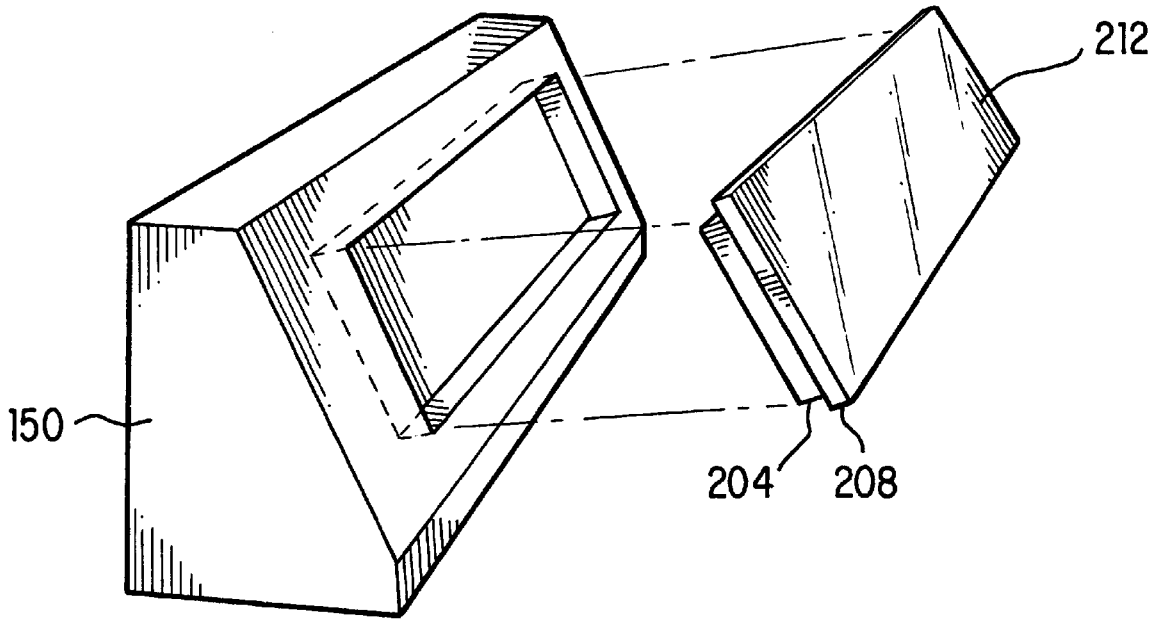
FIG. 2 is an exploded perspective view of a second embodiment of the present invention.

The signs of the present invention will come in basically two embodiments. The first embodiment, shown in FIG. 1, positions a single layer of patterned tile 100 flush with a wooden base 150. This first, flush embodiment is also known as a complete inlay. The second embodiment, a partial inlay as shown in FIG. 2, uses dado-cuts (a stonecutting term meaning to make parallel cuts of different distances) to form multiple levels 204, 208 of tile 212 which conceal the routered-out parts of the wooden base 150.

The two embodiments above each also have two additional variations, which are to have either recessed, sunken lettering, or raised (relief) lettering. Recessed letters are more useful in locations with good lighting such as banks, movie theaters, and office environments. Raised or 'relief' letters, conversely, stand out from the surface of the tile, resulting in easy visibility and readability even in dim light, such as in bars or taverns. The relief also has the effect that the patterning and/or lettering can be discerned at a wider viewing angle. The manifestations of the present invention employing Braille characters use the raised symbols.

The signs of the present invention are put together in basically 3 stages: preparing the wooden base, preparing the tile, and then combining the two.

Preparing the Wooden Base

The dimensions of the wooden base 150 will vary with the size of the granite tile 100, 212. One style of wooden base 150 will be angled upward as shown in FIGS. 1 and 2, while the other will be just "block", that is, meant to sit directly perpendicular with the surface of a desk, or parallel with a wall upon which the wooden base 150 is hung.

To cut the wooden base 150, a table saw is used. To cut rectangular patterns into the wooden base 150, either a standard router or a plunge router can be used. The type of wood used can either be mahogany, birch, black walnut, maple, or cherry, and is chosen partially for its color balance with the granite or marble tile preferred.

When the table saw is first applied to the raw wood, approximately ¼" of extra surface is designed into the process in order to allow for necessary planing of five surfaces of the wooden base 150. At this stage the wood is still considered to be rough-cut. The wooden base 150 is then planed. The planing process smoothes the contours of the wood in order to provide more aesthetically pleasing surface lines. In a preferred embodiment, the planing is done with a double-sided circular blades, although a delta planer, hand plane, joiner, or any combination of these could also be used. After planing is complete, every surface of the entire wood block is then sanded.

Figure 3:
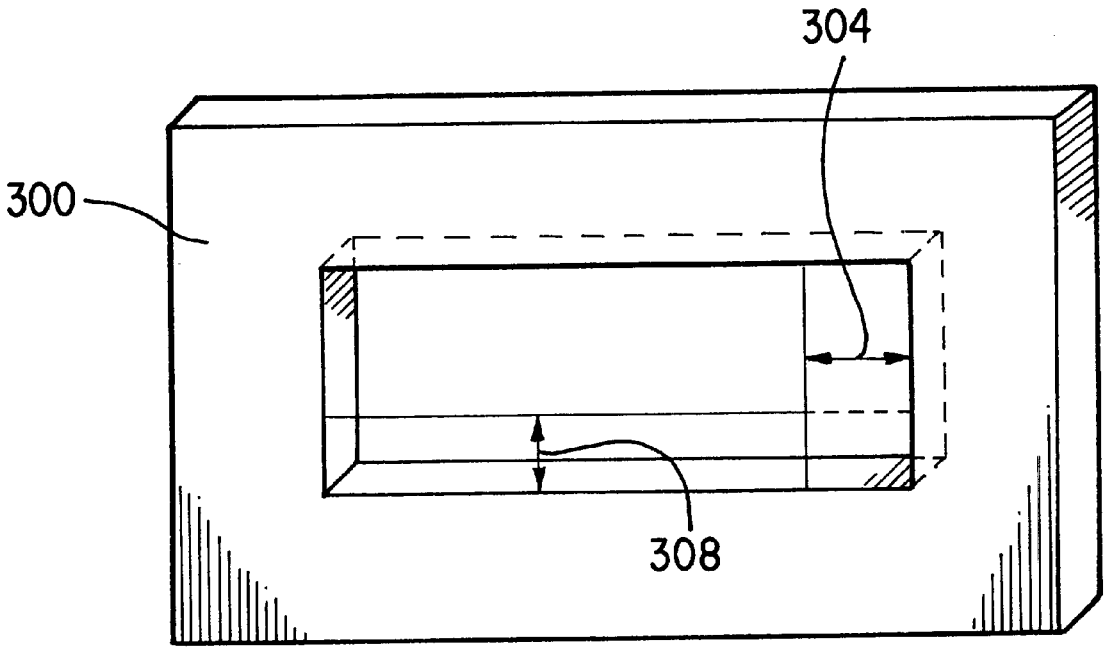
FIG. 3 is a plan view of a sizing jig used in making the present invention.

The routing process can be carried out by a variety of means, including manual as well as computerized routers. To router the rectangular opening 154, a specialized jig 300 for the router can be used, as shown in FIG. 3. The wooden base 150 is clamped to jig 300, and then using a plunge router, a rectangular opening with a depth of approximately ⅜" is routered out from wooden base 150, as shown in FIG. 1. In the FIG. 1 embodiment where the tile 100 sits flush within the wooden base 150, the wooden base 150 is then unclamped from the jig 300, and comers 158, 162, 166, and 170 (FIG. 1) are squared using a comer chisel. Specialized jig 300 also has movable edge guides 304, 308 (FIG. 3) for greater flexibility in the size of the aperture to be routered, thereby broadening the available sizes of the signage of the present invention.

In the non-flush, dado-cut embodiment of FIG. 2, however, it is not necessary to use comer chisel to precisely square corners 158, 162, 166, and 170 in that those comers are not visible in the end product. This is because they are concealed from view by the upper edge 208 of dadocut tile 212.

At this point, the wooden base 150 has been sanded, planed, routed, and cut to the desired dimensions. It is now necessary to spray or brush polyurethane varnish/lacquer/coating (in a preferred embodiment, using MiniWax™) onto the entire wooden base 150. A tong-oil can be substituted for the polyurethane coating. The wooden base 150 is sanded between each coat. The amount of coating varies, because the present invention offers a choice of high, semi, and satin gloss finishes for the wooden base 150. It is not necessary to apply coating to rectangular opening 154, as the entire aperture will be filled in by the tile 100, 212. However, if, during the coating process, a small amount of coating works its way into rectangular opening 154 prior to the positioning of tile 100, 212, no harm is done. Alternatively, a dummy, unused tile can be temporarily positioned in the rectangular opening 154 so that its surface is not coated. Such an action is advantageous in that the glue which will later by applied in the aperture will adhere directly to the surface of the wooden base 150.

Cutting the Tile

A tile saw is used to custom-cut the tile 100, 212. Numerous types of tile saws are usable for this purpose, including a wet powered saw such as an MK-101, a computer controlled laser cutter, or a computer controlled water jet saw. Many wet saws use carbon blades. However, the present invention uses diamond blades, which are advantageous because of superior cutting ability, their ability to be re-sharpened, and longer overall life.

The tile of the present invention is preferably granite, although occasionally marble can be substituted for granite, particularly when there is difficulty finding the optimal shade of white granite. The natural color of the granite used in the tile 100, 212 can be grey, white, black, or gold. Other tile materials such as corian can also be substituted for granite, as well as mica or any other resilient glass made with a high durability and low brittleness. The tiles can be purchased either prepolished or unpolished.

Figure 4:
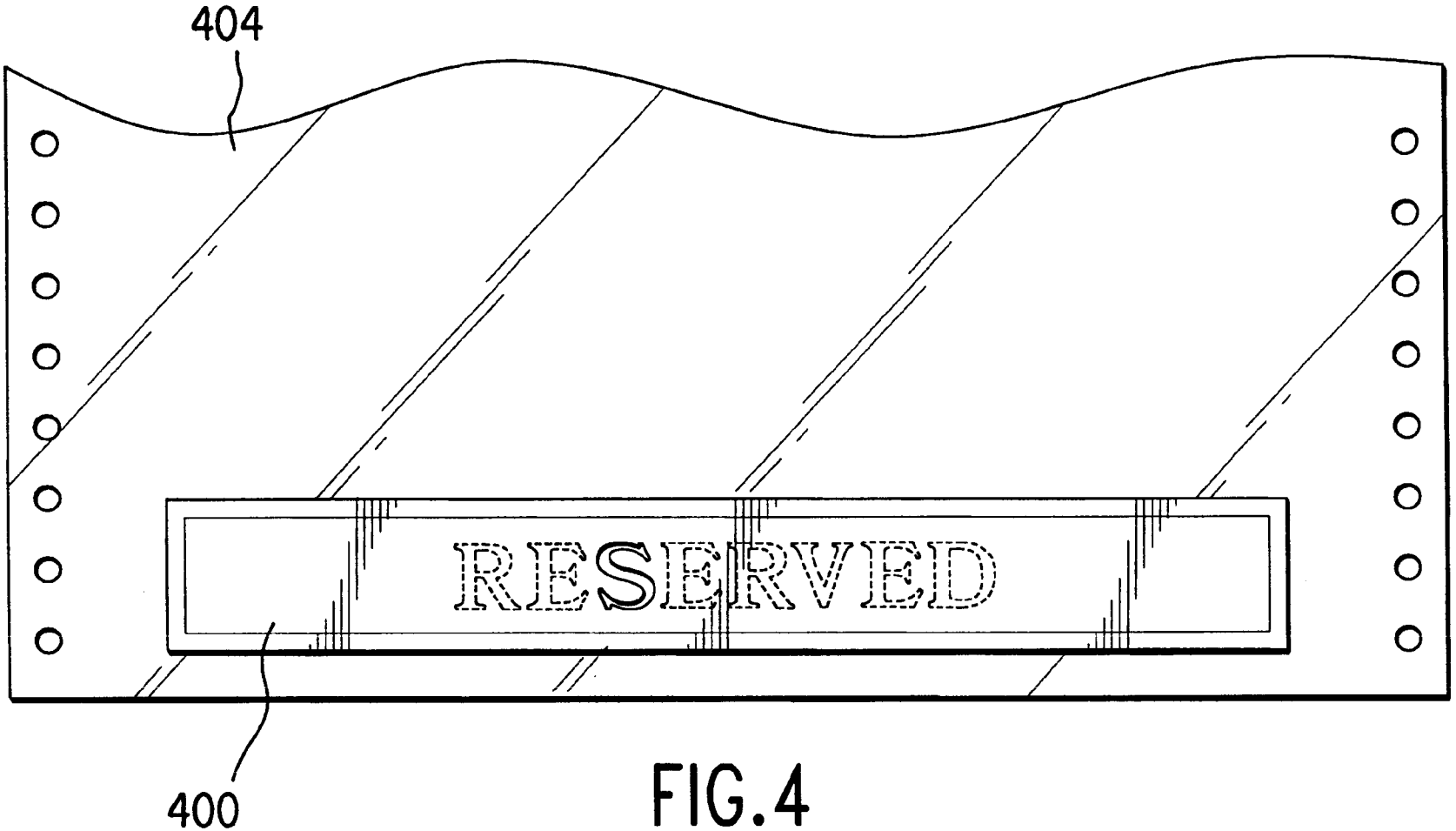
FIG. 4 is a plan view of a rubber stencil used in making the present invention.

The pattern or lettering to be sandblasted into the tile 100, 212 is first created in a rubber stencil 400 such as that shown in FIG. 4 using a rubber-cutting plotter. These stencils are cut by a computer controlling a rubber cutter with both being responsive to specialized software which provides for a wide variety of letter sizing and fonts. The stencil 400 is applied to the tile 100, 212 after the tile is cut, but before it is sandblasted. This is because the sandblasting process is what actually forms the letters or patterns on the tile. For illustrative purposes, the stencil 400 has only the letter 'S' highlighted. As will be explained in more detail below, a single letter 'S' will be used in illustrating the process of patterning the tile.

Figure 5:
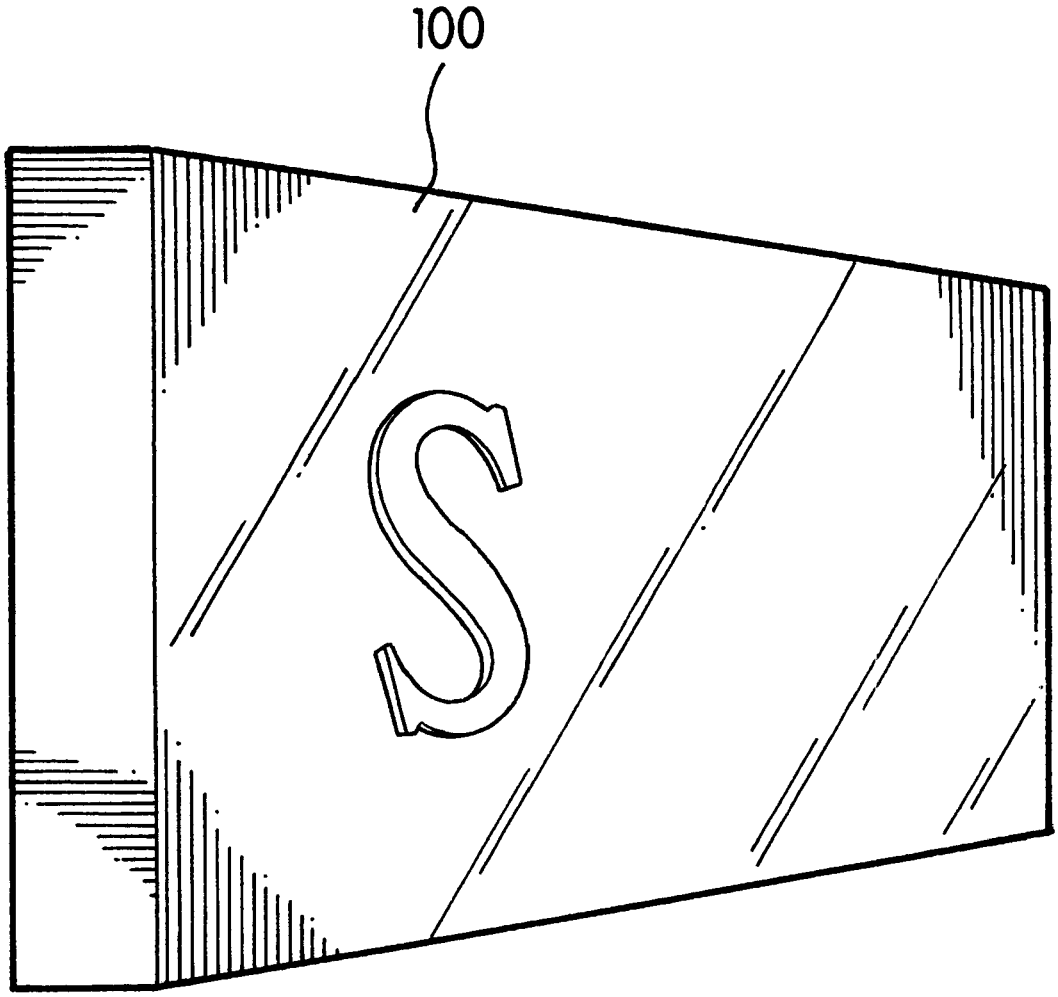
FIG. 5 is a perspective view of a tile for flush mounting within the present invention.

The tile is cut to predetermined dimensions according to whether it will be used as a nameplate, clock, wall hanging, or other device. Additionally, as stated, the tile may be cut either in a single plane/rectangle 100 as shown in FIG. 5, or in a "dado-cut" or "stacked dado" arrangement 212 such as that shown in FIG. 6.

Figure 6:
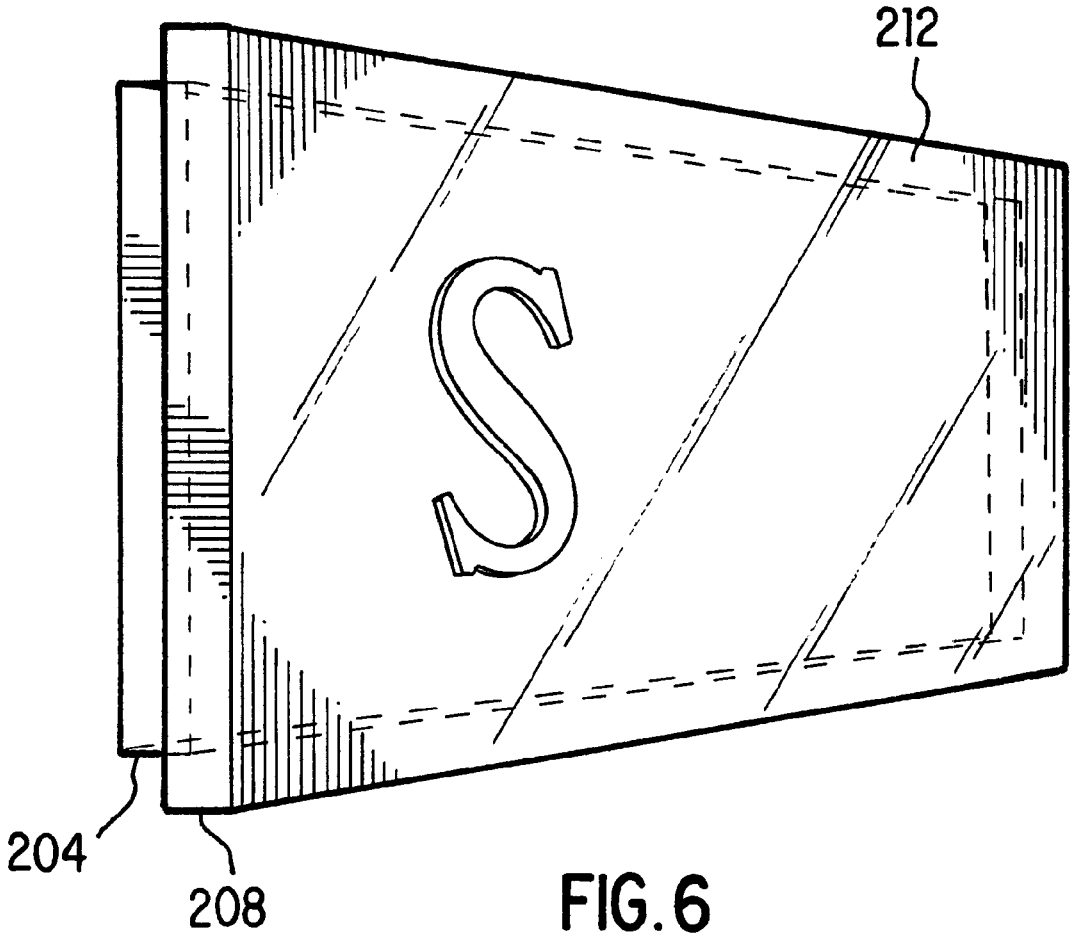
FIG. 6 is a perspective view of a dado-cut tile for mounting within the present invention.

In the stacked arrangement shown in FIG. 6, two separate tile blades are spaced approximately 5 mm apart using a plastic spacer. An operator of an overhead saw can then set the separate depths of the cuts about to be made. The result after cutting is a granite tile having two distinct rectangular surfaces 204 and 208 as shown in FIGS. 2 and 6. Such separate surfaces are useful for aligning the tile 212 within the wooden base 150, increasing the amount of surface area available for patterning, and reducing the amount of finishing necessary for the wooden base 150.

In a preferred setting of the dado-cut embodiment, a ⅜" granite tile sits approximately ⅛" above the wood surface of base 150, with ¼" below the surface. Thus, rectangular surface 204 can be twice as thick as the rectangular surface 208. However, although ⅜" granite tiles are described, other thicknesses such as ¼", ½", and ¾" can also be used. Thicknesses below ¼" are seldom used because the tiles tend to be too brittle for effective patterning and sandblasting.

When dado-cutting tile, it is convenient to put another scrap piece of tile behind and in front of the tile 212, thus ensuring uniformly equal depth of the dado-cut. This also keeps the tile 212 slightly raised from the cutting surface of the saw. In the event a water saw is used, depth equality is ensured through precision control of the water jet.

Using a wet saw such as an MK-101 keeps the granite dust down. For polishing the edges of tile 100, 212, a wet sander is used. However, the edges can also be polished manually, using several different grades of sandpaper. This completes the explanation of the cutting of the granite tile 100, 212 prior to pattering.

Patterning the Tile

Figure 7:
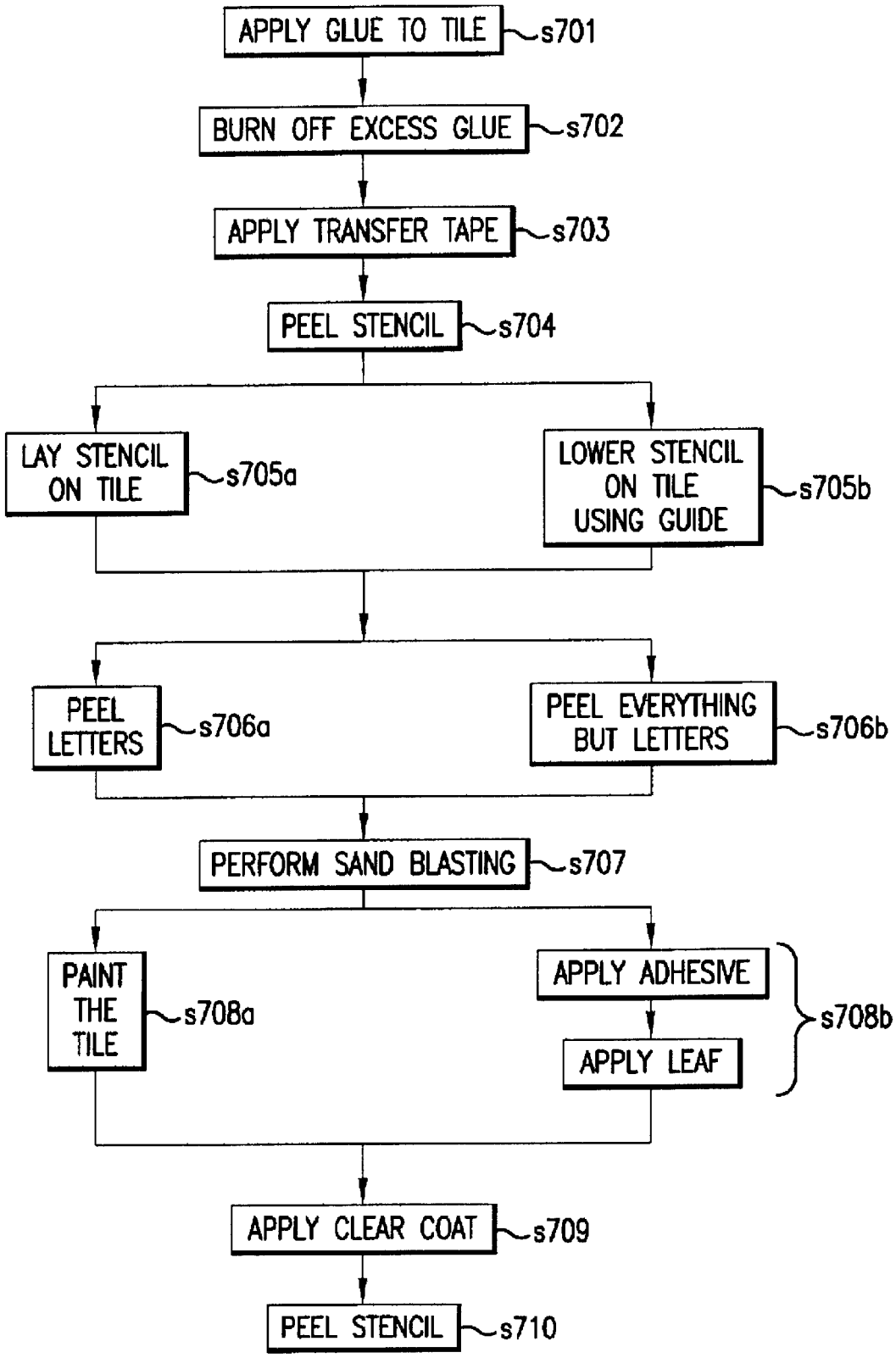
FIG. 7 is a flowchart for the steps of patterning a tile.

The process of patterning the tiles 100, 212 with the stencil 400 will now be explained. As shown in FIG. 7, step 701 is to apply a stencil glue to the tile. Step 702 is to melt or bum off the excess, residual glue from the tile. Step 703 is to apply transfer tape onto the stencil 400. Step 704 is to peel the stencil 400 up off a plastic carrier/backing 404, either by hand or using a stencil knife. Step 705*a* is to lay the stencil 400 on the tile 100, 212 (one chance only, thus precision very important), OR as an alternative to step 705*a* which is step 705*b* slowly lower the tile 100, 212 onto the stencil 400 using a 90-L shaped guide. The 90-L shaped guide allows the operator to slowly lower the tile onto the stencil 400 while observing whether tile and stencil are properly aligned. Doing so increases the precision at which the stencil 400 can be aligned to the tile, and reduces the amount of improperly applied stencils which must then be discarded.

Step 706 is to expose the parts that are going to receive sandblasting. In the raised letters embodiment, the rubber stencil covers the letters only. Then, everything but the letters is sandblasted, as the area of the tile covered by rubber is protected from being sandblasted. The rubber stencil is then removed.

Conversely, in the recessed letters embodiment, the rubber stencil covers everything but the letters. Then, only the letters are sandblasted, as the area of tile covered by the rubber is protected from being sandblasted.

Because step 706 differs depending on whether raised or recessed letters are being produced, step 706 is divided into alternatives 706*a* and 706*b,* as shown in FIG. 7. Step 706*a* is executed in the recessed letter embodiment, which is to pull up the rubber lettering/symbols, leaving the surrounding areas of rubber remaining on the tile, OR step 706*b*) (supposing raised letter embodiment) pull up the areas of rubber stencil surrounding the lettering. This is the embodiment shown in FIGS. 5 and 6, where for brevity and clarity only the letter 'S' is to be patterned, and all areas of the rubber stencil 400 surrounding the lettering are pulled up or removed.

Step 707 is to perform the actual sandblasting. To sandblast the tile 100, 212, an air compressor is used, such as a Linsday™, in combination with a sand-holding device. The type of sand used can be StarBlast™. After sandblasting, while the stencil 400 is still attached to the tile, step 708 is to spray paint the letters (recessed) or background (raised, relief) using 4 different spraying angles. In a preferred embodiment, lithochrome spray paint is used, in gold, white, grey, black, or red.

As an alternative to step 708*a,* step 708*b* shows that gold or silver leaf can be used to paint the letters or background. Prior to the application of the leaf, an adhesive must first be applied. In the recessed embodiment, the gold or silver leaf is applied in the recessed-letter areas, using tools such as brushes or small punches. The excess fine leaf paper is easily torn away, leaving behind only the desired surfaces covered in leaf. In the raised-letters, relief embodiment, apply adhesive to all sandblasted areas. Then apply the leaf, being careful to not get any adhesive on the letters themselves.

After the four coats of paint or leaf, step 709 is to apply four coats of clear coat also at four different directions, letting the tile dry between each coat. Finally, after all coats are dry, step 710 is to peel off the rubber stencil 400.

After being subjected to sandblasting and then spraying, the rubber stencil 400 is normally stretched and altered so much that it's no longer usable. However, within the present invention, a specialized rubber of an unusually high tensile strength is used. In this way, the rubber stencil 400 is preserved for repeated usages without the necessity of replacing the stencil for every new tile. This is advantageous for lowering stencil costs. This completes the explanation of the patterning of the tile.

At this point, the tile 100, 212 has been patterned, blasted, painted, and cut to the proper width. Where appropriate, the tile's back has been dadoed off and the edges have been polished. As stated earlier, the wooden base 150 has been cut to the desired dimensions, sanded, planed, routed, and coated. Accordingly, the wooden base 150 and granite tile 100, 212 are now ready to be combined.

Combining the Tile and the Wooden Base

The granite tile 100, 212 is inlayed into wooden base 150 using a glue such as platinum epoxy and resin glue. This glue is recommended because it is made specifically for granite, and is high strength, clear, and colorless. During the glue-setting process, devices such as presses, clamps, fans, heaters, and humidifiers are used. The suggested length of time for allowing the glue to set is five hours. A belt dresser is used to remove any excess glue.

Additional features of the present invention can include combining the wooden base 150 with a business card holder, small clocks, and/or a pen socket. Other office accessories can also be combined with the present invention where appropriate. The present invention can also be wall-mounted, and can have Braille indices. Further, the bottom of the wood base can have rubber feet or black felt attached to the bottom by an adhesive.

It is anticipated that various changes may be made in the arrangement and operation of the-system of the present invention without departing from the spirit and scope of the invention, as defined by the following claims.

What is claimed is:

1. A method of manufacturing a sign from tile and wood, comprising:

preparing a wooden base, comprising:

rough-cutting a block of wood;

routering an aperture in said rough-cut block to a predetermined depth; and sanding and polishing said block into a wooden base;

preparing a tile to display a message, comprising:

preparing a rubber stencil containing said message;

applying said rubber stencil to said tile;

peeling portions of said stencil from those sections of said tile desired to be exposed to sandblasting; and sand-blasting exposed surfaces of said tile;

repeatedly polishing edges or sides of said tile;

combining said wooden base and said tile, comprising:

gluing said tile within said aperture created in said wood; and drying said glue.

2. The method of claim 1, wherein said step of preparing a tile further comprises:

applying said rubber stencil to said tile using a 90-L guide to assist alignment.

3. The method of claim 1, wherein said step of preparing a tile further comprises:

applying spray paint or leaf either to said exposed surfaces or everywhere but said exposed surfaces.

4. The method of claim 1, wherein said step of preparing a wooden base further comprises:

cutting a front surface of said wooden block at an angle.

5. The method of claim 1, wherein said step of preparing a tile further comprises:

dado-cutting a tile into two rectangular surfaces.

6. The method of claim 1, wherein said step of preparing a wooden base further comprises:

using a sizing jig to assist said routering step.

7. The method of claim 6, wherein said sizing jig has a plurality of movable edge guides.

8. The method of claim 1, wherein said wooden block is made from either mahogany, birch, black walnut, maple, or cherry.

9. The method of claim 1, wherein said tile is made from either granite, marble, corian, mica, quartz, or glass.

10. The method of claim 1, wherein said polishing step further comprises:

inserting a piece of dummy tile into said aperture in order that said aperture does not receive polish.

11. The method of claim 5, wherein said dado-cutting step further comprises:

inserting pieces of dummy tile above and below said tile containing said message.

12. The method of claim 1, wherein said step of preparing a tile further comprises:

applying a stencil glue to said tile.

13. The method of claim 1, wherein said step of preparing a tile further comprises:

melting or burning of off the excess glue from said tile.

14. The method of claim 1, wherein said step of preparing a tile further comprises:

transferring tape onto said stencil.

15. The.method of claim 1, wherein said step of preparing a tile further comprises:

peeling said stencil up off a plastic carrier/backing, either by hand or using a stencil knife.

16. The method of claim 1, wherein said step of preparing a tile further comprises:

laying said stencil on said tile.

17. The method of claim 1, wherein said step of preparing a tile further comprises:

lowering said tile onto said stencil using a 90-L shaped guide.

18. The method of claim 1, wherein said step of preparing a tile further comprises:

applying four coats of clear coat at four different directions, and letting the tile dry between each coat.

19. The method of claim 1, wherein said step of preparing a tile further comprises:

peeling off said rubber stencil.

20. The method of claim 19, wherein said step of preparing a tile further comprises:

re-using said peeled rubber stencil.

21. The method of claim 1, wherein said step of preparing a wooden base further comprises:

cutting said wooden block to have dimensions approximately ¼" larger than said wooden base.

* * * * *